US005512754A

United States Patent [19]

Enos

[11] Patent Number: 5,512,754

[45] Date of Patent: Apr. 30, 1996

[54] FILTERED COLLIMATOR FOR DUAL ISOTOPE MEDICAL IMAGING

[75] Inventor: Gary W. Enos, Macedonia, Ohio

[73] Assignee: Summit World Trade Corp., Hudson, Ohio

[21] Appl. No.: 338,431

[22] Filed: Nov. 14, 1994

[51] Int. Cl.[6] ..... G21K 1/02

[52] U.S. Cl. ..... 250/363.1; 378/147; 378/149

[58] Field of Search ..... 250/363.1; 378/147, 378/149

[56] References Cited

U.S. PATENT DOCUMENTS

| | | | |
|---|---|---|---|
| 3,943,366 | 3/1976 | Platz et al. . | |
| 4,323,779 | 4/1982 | Albert | 378/98.8 X |
| 4,348,591 | 9/1982 | Wunderlich . | |
| 4,528,453 | 7/1985 | Heller . | |
| 4,597,096 | 6/1986 | Larsson . | |
| 5,239,568 | 8/1993 | Grenier | 378/147 |
| 5,309,911 | 5/1994 | Greiner | 250/363.10 X |

FOREIGN PATENT DOCUMENTS

| | | | |
|---|---|---|---|
| 3507340 | 9/1985 | Germany | 378/147 |

OTHER PUBLICATIONS

*Measurement and Detection of Radiation,* by Nicholas Tsoulfanidis, University of Missouri–Rolla, Hemisphere Publishing Corp., Copyright 1983, pp. 357–360.

*The Fundamentals of X–Ray and Radium Physics,* Seventh Edition, By Joseph Selman, M.D., Published by Charles C. Thomas, Copyright 1985, pp. 207–209.

*Half Value Layers at Photon Energies from 10 KeV to 10 MeV,* by Gerlad L. Rhinehart and Norman F. Modine, U.S. Department of Health, Education, and Welfare, Apr., 1968, 4 pages.

*Primary Examiner*—Carolyn E. Fields
*Assistant Examiner*—Edward J. Glick
*Attorney, Agent, or Firm*—Frank J. Nawalanic

[57] ABSTRACT

An X-ray collimator is provided to permit diagnostic medical imaging of two or more radioactive isotopes emitting spectrically close gamma rays. The collimator includes a filter plate at one or both ends of the collimator's tubular passageways with the filter plate having a plurality of openings extending therethrough which are aligned and coincident with the tubular passageways. The openings in the filter provide a thin filtering edge adjacent the collimator passageway ends which interact with and remove substantially most of the unwanted secondary and scattered radiation produced by photons striking septa within the collimator's passageways.

16 Claims, 3 Drawing Sheets

FILTERED COLLIMATOR FOR DUAL ISOTOPE MEDICAL IMAGING

FIELD OF INVENTION

This invention relates generally to collimators for use in medical X-ray imaging and more particularly to collimators for use in simultaneous dual isotope data acquisition and imaging.

The invention is particularly applicable to and will be described with specific reference to nuclear medicine cameras using scintillation crystals to detect radiation. However, those skilled in the art will understand that the invention has broader application and can be applied to any nuclear camera using any radiation detector such as semi-conductor or gas filled detectors.

BACKGROUND OF THE INVENTION

In medical emission tomography, the physical functions of body organs and related biochemical processes such as iodine metabolism of the thyroid, glucose metabolism of the brain and heart, and blood flow to the heart, muscle and brain is measured by the emission of photons (gamma rays) from radioactive isotopes administered to the patent. Specifically, the isotopes selected have decay characteristics which produce gamma rays having defined energy characteristics, the intensity and location of which are recorded as data and imaged by a nuclear camera.

There are medical applications where two or more isotopes are desired to be imaged simultaneously. Specifically, thallium (i.e., thallium 201 as thallus chloride) has been used in imaging the heart to localize myocardial infarcts. Technetium (i.e., technetium 99m) has been used in lung imaging. Simultaneous imaging of both isotopes is desired so that technetium can be utilized to record the heart's response to stress and thallium can be utilized to image the heart's rest or redistribution state to show its recovery from stress.

Simultaneous data acquisition and imaging of two or more spectrally close isotopes has heretofore not been successfully accomplished by Anger cameras using scintillation crystals such as NaI. Improvements have, however, continued to be made to the resolution of nuclear cameras to better define the pulse height spectrum produced by the gamma rays. Energy resolutions of gamma camera systems have improved from a variance range of about 10.5% to 12% @ 140 KeV to a range today of about 8.5% to 9.75% @ 140 KeV. This is a significant improvement in terms of what is required mathematically of the photopeak window to permit imaging. In theory, and until the present invention, it is now possible to simultaneously image spectrally close isotopes such as technetium and thallium. While the camera resolution has improved to where the camera can now accurately discriminate between gamma ray emissions at differential levels as low as about 50 KeV, it has been discovered through experimentation that accurate scintigrams have not been produced because of scattered and secondary cross channel radiation occurring within the collimator which spills scattered photons and K-shell X-rays into the scintillation crystal. Although the quantity of the cross channel radiation is not significant, it has been determined, surprisingly, that such radiation adversely effects the photopeaks preventing accurate imaging of at least one of the gamma rays and/or distinguishing between the two radiations.

Until the invention, the problem has not been resolved. In conventional practice, Anger cameras are fitted with removable collimators having varying thickness for collimating X-rays and gamma rays of varying energies. Collimators are typically classified as thin, medium and thick with the thick collimators weighing in excess of 500 lbs for collimating X-rays having high radiation energies. Within the art, various devices have been proposed to vary the length of the tubular passageways so that one collimator can be used for all radiation energies. See for example Wunderlich U.S. Pat. No. 4,348,591, Heller U.S. Pat. No. 4,528,453 or Larsson U.S. Pat. No. 4,597,096. Such collimators do not address and are not capable of simultaneously analyzing two or more isotopes.

It has long been known in radiology to use filters to "harden" the radiation beam so that the X-ray beam has a higher percentage of higher energy, more penetrating photons. It has also been known with monoenergetic radiation such as cobalt 60 gamma rays, that filters are not used to harden the radiation (since Co60 evidences two discrete energies) but are used as beam-flattening filters. Various compound filters such as the Thoreaus filter are used to increase the radiation exposure rate (*The Fundamentals of X-Ray and Radium Physics,* 7th Edition, Joseph Selman, published by Charles C. Thomas, 1985, pages 207–209). Filters are placed in the path of the radiation beam to attenuate or flatten the beam. Placing filters in the path of the gamma radiation for photon emission tomographs (PET) would simply attenuate the radiation making detection more difficult.

A number of mathematical techniques and formula (pulse shape discrimination, i.e., PSD) have been utilized to differentiate pulses produced by different types of particles in the source detector. In fact, all cameras use some type of band pass methodology to provide pulse height discrimination. To the extent the particles exhibit different energies, such techniques are acceptable. However, if the particles exhibit similar energies, the techniques cannot, by definition, discriminate. Thus, the discriminators serve only to reduce the primary and a small fraction of the secondary emissions produced. The active window width secondary emission faction remains unchanged. Furthermore, because the cross channel radiation occurs sporadically or randomly in time, it is not possible to use statistical techniques, conventionally known as "binning", to artificially modify the pulse height shape to account for variations.

One approach described in the literature eliminates or reduces that portion of the energy spectrum detected in a Na(Tl) scintillator or a Ge(Li) detector attributed to the Compton effect which is known as a Compton-suppression spectrometer. The Compton-suppression spectrometer uses two detectors which are operated in anticoincidence. One specific arrangement uses a larger NaI(Tl) scintillator which surrounds a Ge(Li) detector. When the two detectors are operated in anticoincidence, the center Ge(Li) detector will consist of pulses that result from total energy absorption in that detector. (*Measurement and Detection of Radiation,* Nicholas Tsoulfanidis, published by Hemisphere Publishing Corporation, 1983, pages 357–360). While this approach may eliminate some secondary radiation it does not take into account scattering and requires two detectors and associated electronics. Further, the energy spectrum attributed to the Compton effect, while always a nuisance, does not cause the problem preventing simultaneous imaging, and is otherwise addressed by the band pass discrimination methods discussed above.

SUMMARY OF THE INVENTION

Accordingly, it is a principal object of the invention to provide a filtering collimator which permits simultaneous imaging and/or data acquisition of gamma or X-ray radiation sources producing spectrally close energies.

This object along with other features of the invention is achieved in an X-ray collimator for use in a medical camera which includes a body or septa of radioactive absorbing material having an entrance end adjacent a source of radiation and an exit end adjacent a radiation sensing medium with the body having a plurality of tubular passageways extending therethrough. A filter material having an edge thickness is affixed to one of the body ends with the filter having a plurality of openings extending through the edge thickness equal in number to the passageways. Each opening in the filter material is aligned with a corresponding passageway to be coincident and contiguous with the passageway at the end thereof whereby cross channel scattered and secondary X-rays are substantially absorbed by the filtering material.

In accordance with other features of the invention, the filter is positioned preferably adjacent the exit end of the tubular passageway or alternatively, at the entrance end or at both ends of the passageway whereby a substantial portion, in the neighborhood of 80% to 90%, of the cross channel scattered and secondary radiation is filtered by the filtering material.

In accordance with other aspects of the invention, the tubular passageway can divergingly increase or convergingly decrease in cross-sectional area. The collimator body may be a casting, or stamping, or a metallic foil folded to form the tubular passageway with the filter comprising a selected coating secured to the foil. If the body or septa is a casting, the passageways are produced by core pins which are subsequently dissolved by a chemical etch with the pins having a coating at their ends of filter material which is impervious to the chemical etch.

In accordance with another feature of the invention, a nuclear camera is provided for simultaneously recording two or more source radioactive isotopes having half-life characteristics emitting distinctive gamma rays at energy levels spectrally close to one another with the camera including a radiation sensing mechanism for sensing the gamma rays emitted by the isotopes and a digital processing mechanism for producing voltage pulses proportional to the energy of the gamma rays detected by the radiation sensing mechanism. A collimator is interposed between the radiations sensing means and the source isotopes with the collimator having a radiation absorbing body extending between an entrance end and an exit end and having a plurality of tubular passageways extending therethrough from the entrance to the exit end. A filter plate is affixed to one of the collimator ends. The filter plate has a plurality of openings equal in number to the tubular passageway with each opening defined by a filtering edge shaped to be coincident with the tubular passageway at the end thereof and aligned with a corresponding passageway so that the filtering edge extends the passageway a distance equal to the thickness of the filter plate whereby the scattered and secondary radiation of at least one of the isotopes is substantially absorbed by the filter edge.

It is another object of the invention to provide a collimator which significantly reduces K-shell X-rays and lower energy scattered photons resulting from collimator cross channel absorption.

Still another object of the invention is to provide a nuclear medicine scintillation camera with an improved acquired photopeak data window.

A still further object of the invention is to provide a nuclear camera using an inorganic scintillation crystal which can simultaneously image and/or collect data for two isotopes having similar spectra energies.

Still another object of the invention is to provide a filtering collimator for use in an emission tomography system which removes unwanted K-shell fluorescent X-rays from the principal photopeak or pulse height spectrum produced by the system.

A still further object of the invention is to produce an improved collimator which filters unwanted scattered and secondary radiation by a simple mechanism which can easily be incorporated into the collimator without undue expense.

Yet another object of the invention is to provide an improved collimator for simultaneous dual isotope imaging in a nuclear camera, which substantially reduces cross channel scattered and secondary radiation from the photopeaks window but which does not change the collimator geometry or sizing or attenuation characteristics.

A specific but important feature of the invention is to provide a filtering collimator capable of permitting an Anger type camera to image spectrally close isotopes but without affecting the collimator hole or core size, the septal thickness and/or core length, thus permitting the invention, conceptually to be retrofitted to existing collimators.

Still yet another specific feature of the invention is to utilize graded absorbers at the collimator edge openings to filter cross channel scattered photons and K-shell X-rays to minimize the length of the filter thereby maintaining collimator geometry to permit differentiation of spectrally close isotopes during medical imaging.

These and other objects, features and advantages of the invention will become apparent from the following Detailed Description taken together with the accompanying drawings.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
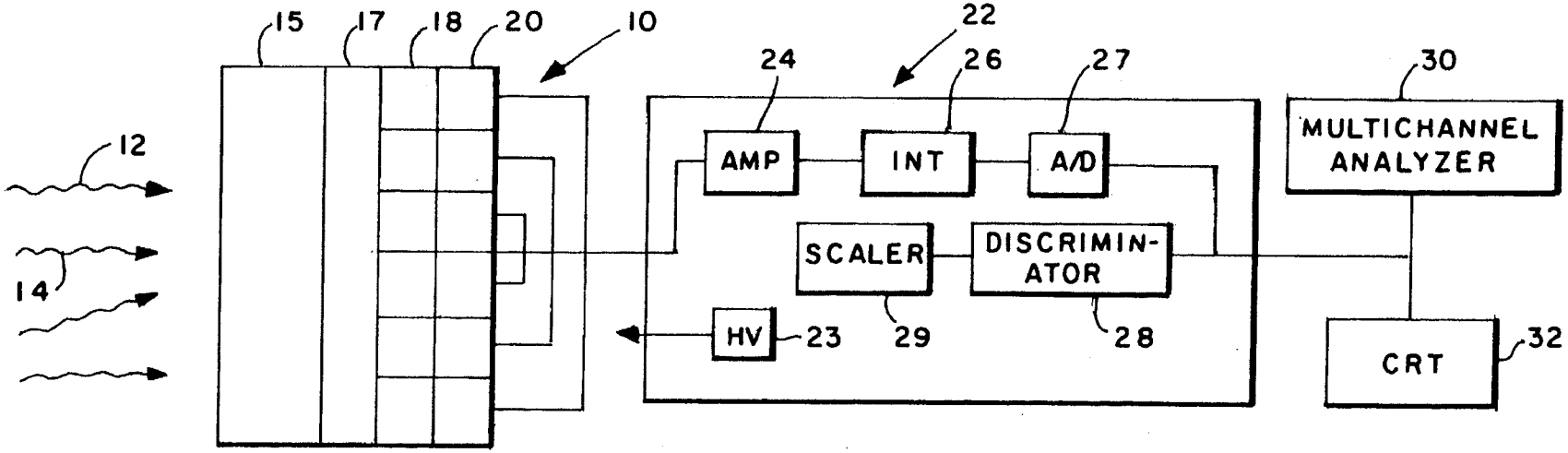
FIG. 1 is a schematic drawing of a nuclear camera.

Referring now to the drawings wherein the showings are for the purpose of illustrating preferred and alternative embodiments of the invention only and not for the purpose of limiting the same, there is shown in FIG. 1, a nuclear medical camera 10 of the Anger type which receives two or more gamma rays 12, 14 emitting different but closely related characteristic radiation. Camera 10 includes a collimator 15 which receives gamma rays 12, 14 and directs them onto a detector 17. In the preferred embodiment detector 17 is a scintillation device such as a thallium doped NaI crystal. In accordance with the broader aspects of the invention, any gamma or X-ray detector such as semiconductors or gas-fill detectors could be employed. However, the invention was specifically developed for scintillation detectors and while a sodium iodide crystal is used in the preferred embodiment, other inorganic crystals as well as organic and gaseous scintillators can be employed. As is well known, scintillation detector 17 produces light bursts when penetrated by X-rays or gamma rays. The scintillated light is transmitted by fibre optics or light tubes 18 to a plurality of photomultipliers 20 which convert the light to an analogue electrical signal.

As noted in the Background discussion, Anger camera 10 is typically provided with various collimators 15 having different thicknesses. Gamma rays 12, 14 have characteristic radiation which are spectrally similar to the extent they can be simultaneously collimated by the same collimator. This means that the emitted gamma rays are spectrally close to one another so that one of the three different collimators supplied can "collimate" both gamma rays. However, for definitional purposes, spectrally close gamma rays means gamma rays adequately collimated by any one collimator 15 of any given thickness. Also, merely for definitional convenience "X-rays" as used herein and in the claims means any electromagnetic radiation having wave length less than ultraviolet light and includes but is not limited to gamma rays. "Rays" means any electromagnetic radiation.

In the preferred embodiment, first gamma ray 12 is Technetium 99m which produces characteristic radiation of 140 KeV. As noted above, this radionuclide has been used with macroaggregated serum albumin to provide indirect evidence of pulmonary arterial emboli or thrombosis. The albumin particles are large enough to lodge temporarily in the normal pulmonary capillary bed, thereby indicating that blood is reaching the capillaries. As noted above, Technetium is used to record the hearts response to stress. Thallium emits characteristic gamma rays in the range of 60–80 KeV, typically 70 KeV. Thallium 201 as thallus chloride is proving to be valuable in imaging the heart to localize myocardial infarcts and determine their extent. As noted above, thallium is used to ascertain the heart's rest or redistribution state to show its recovery from stress. Thus, in order to simultaneously monitor the hearts ability to both react to stress and to recover from stress, the patent is injected with the two radioactive isotopes, technetium and thallium.

Referring still to FIG. 1, the analogue output from photomultipliers 20 is processed in a conventional signal processor circuit indicated by reference numeral 22. Signal processor circuit 22 includes an HV power supply 23, an amplifier (and preamplifier) 24, and a number of special circuits. The circuits include a timing or integrating circuit 26 for switching or gating the photomultiplier signal; an analogue to digital circuit 27 for digitizing the analogue signal and a discriminator circuit 28 for setting high and low bands within which the radiation is detected and to which a scaling circuit 29 applies a scaling factor (i.e., pulse shape discriminator). The process signal is then inputted to a multi-channel analyzer 30 for data acquisition and/or through a CRT tube 32 for visual observation. The pulse height data is, of course, utilized by a computer, not shown, to generate the desired imaging either in the form of scintigrams or tomographs which can be displayed on CRT tube 32.

As is well known in the art, gamma rays 12, 14 pass through collimator 15 and penetrate detector 17 to generate light bursts which, in turn, are converted to electrical impulses in photomultipliers 20 which are correlated to the intensity or energy of gamma rays 12 and 14. Signal processor circuit 22 then refines the electrical signals produced by photomultipliers 20 to determine the location and relative intensities of the gamma rays emitted from the patient which, in turn, are used as described to produce scintigrams and tomographs. Each photomultiplier produces an electrical pulse shown as a photopeak in a window stored in a multi-channel analyzer 30 or alternatively, displayed on an oscilloscope or CRT tube 32, the pulse height of which is then analyzed as noted, etc. Again, it is to be understood that the electronic signal processing scheme is conventional and that which is illustrated is generally typical from a functional view. The electronic processing circuit does not, per se, form part of the invention although its use is required to practice the invention.

Figure 2:
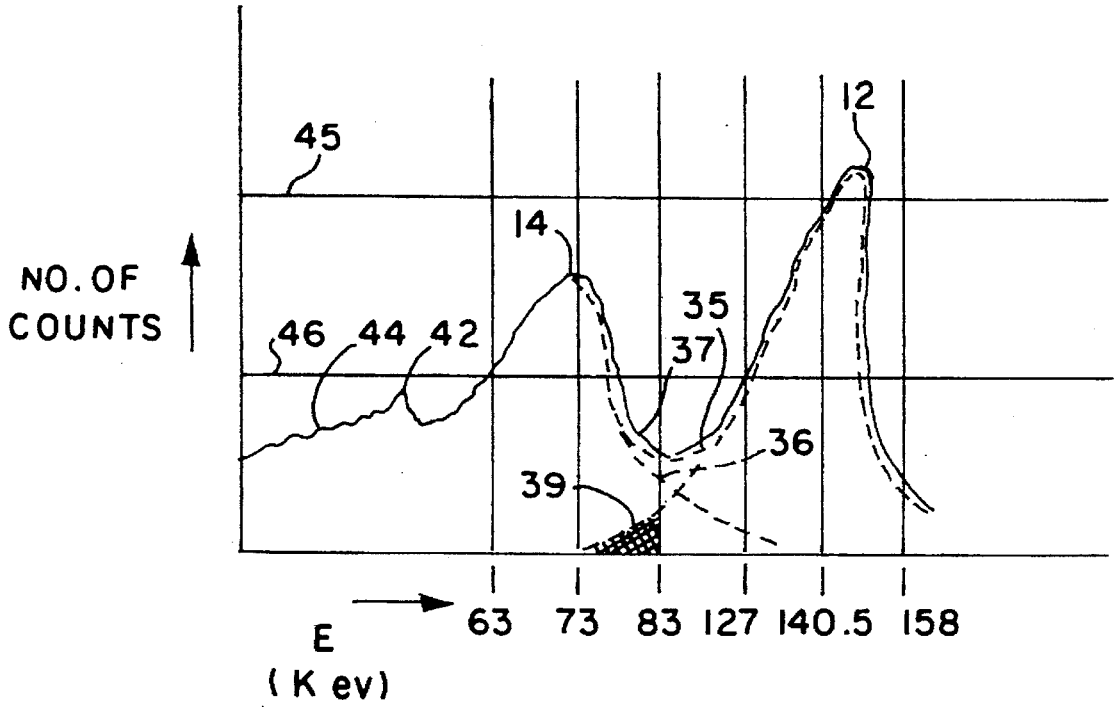
FIG. 2 is an energy spectrograph showing the photopeak or pulse height distribution of gamma rays produced by two radioactive substances imaged or recorded by the nuclear camera of FIG. 1 using the present invention.

A spectrum trace of the electrical pulse produced by any given photomultiplier 20 for the two sources of gamma radiation 12, 14 is represented in FIG. 2 which depicts what a theoretical image looks like (and approximates what the trace would appear as utilizing the present invention). The energy of the gamma ray is expressed as electron volts on the abscissa. Alternatively, the abscissa could be plotted as the channel numbers used in multi-channel analyzer 30. On the ordinate is plotted the number of counts or electrical pulses produced by the photomultiplier 20 which corresponds to the gamma ray photons detected. Alternatively, depending on the signal processor circuit 22, voltage produced by photomultiplier 20 could replace the number of counts. Two peaks are shown to occur. In the preferred embodiment, technetium gamma ray 12 produces a sharp peak at 144 KeV which corresponds to its characteristic energy level. (In practice, the "peak" occurs at 140.5 KeV) Thallium ray 14 produces a flatter peak extending between 60–80 KeV (technically, mercury X-rays) which represents its nominal characteristic or fluorescent energy level at 70 KeV. (In practice, the "peak" occurs at 73 KeV.) Each ray 12, 14 has a characteristic decay portion after it passes through the "standard deviation" limits of the photopeak window which limits for technetium ray 12 are set, in practice, at 127 and 158 KeV and, in practice, are set at 63 and 83 KeV for thallium ray 14. The decay portion of thallium ray 14 shown by reference numeral 35 in FIG. 2 is additive with the decay portion of technetium ray 14 shown by reference numeral 36 in FIG. 2 to produce a composite curve portion designated by reference numeral 37 between the technetium and thallium photopeak pulses. It should be noted that technetium decay position normally extends into the thallium photopeak window and distorts the thallium photopeak curve, but not significantly. This is diagrammatically shown by the cross-hatched area indicated by reference numeral 39 in FIG. 2.

Also shown in FIG. 2 is that portion of the spectrum attributed to the Compton effect designated by reference numeral 40 and the backscatter radiation peak 42. Not shown is the scattered radiation attributed to crystal 17 which would appear as a second peak at the energy level occupied by the thallium radiation. Also, to differentiate between pulses produced by different types of particles in scintillator 17 a pulse shape or height discrimination technique is effected by scaler 29 and discriminator 28 and is diagrammatically represented in FIG. 2 by maximum band line 45 and minimum band line 46. Pulses falling within bands 45, 46 set by discriminator 28 are captured. As noted above, the resolution capability of nuclear cameras 10 of the Anger type employing sodium iodide crystals has increased significantly so that observed photopeaks as illustrated in FIG. 2 accurately portray the true resolution of the gamma energies from a previous range which was accurate within 10.5% to 12% at 140 KeV to a range which is accurate within 8.5% to 9.75% at the 140 KeV energy. While the resolution improvement is only a few percentage points, the improvement is significant when imaging scintigrams and tomographs. Everything described thus far is conventional and known in the art.

Figure 4:
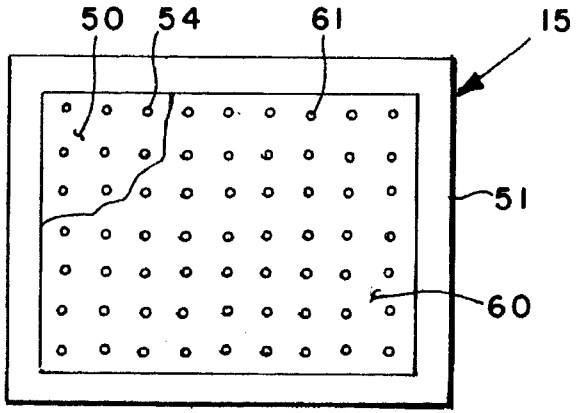
FIG. 4 is a plan view of a collimator.
Figure 5:
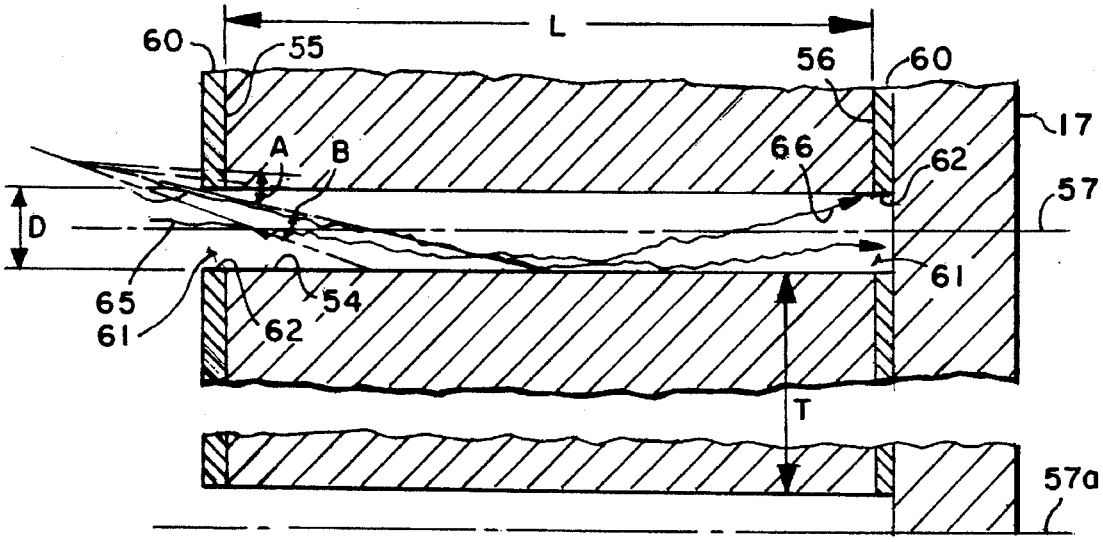
FIG. 5 is a cross-sectional view of the collimator taken through one of its passageways and showing a portion of the scintillation crystal adjacent thereto.

Referring now to FIGS. 4 and 5, collimator 15 typically comprises a body 50 of radioactive absorbing material or septa ("body" and "septa" will be used interchangeably with one another) which is inserted into a frame 51 which, in turn, is adapted to be removably attached to nuclear camera 10. In the preferred embodiment, the radioactive absorbing material or septa 50 is lead. In accordance with the broader aspects of the invention, other radioactive absorbing material of high atomic number Z with appropriate thickness can be used. Within body 50 is a plurality of collimator tubular collimator passageways 54 orientated in a specific pattern to align with photomultipliers 20 in conventional arrays with each tubular passageway concentric about a longitudinally-extending centerline 57. Further, the thickness of septa 50 designated as "L" in FIG. 5, the wall thickness distance between tubular collimator passageways 54 designated as "T" in FIG. 5 and the diameter or area of tubular collimator passageway 54 designated as "D" in FIG. 5 are all conventional. That is, sizing of collimator 15 is dependent upon the energy of X-rays or gamma rays 12, 14 and it is not changed or altered by the present invention. Thus, conventional collimator sizing techniques are used to determine the size of tubular passageway opening "D", septa thickness "T", tubular configuration and orientation to insure passage of a sufficient number of gamma rays through tubular collimator passageways 54 which insures adequate and sufficient scintillation counts by scintillation detector 17. Thus, the invention contemplates retrofitting existing collimators to practice the invention should retrofit techniques prove feasible.

Figure 3:
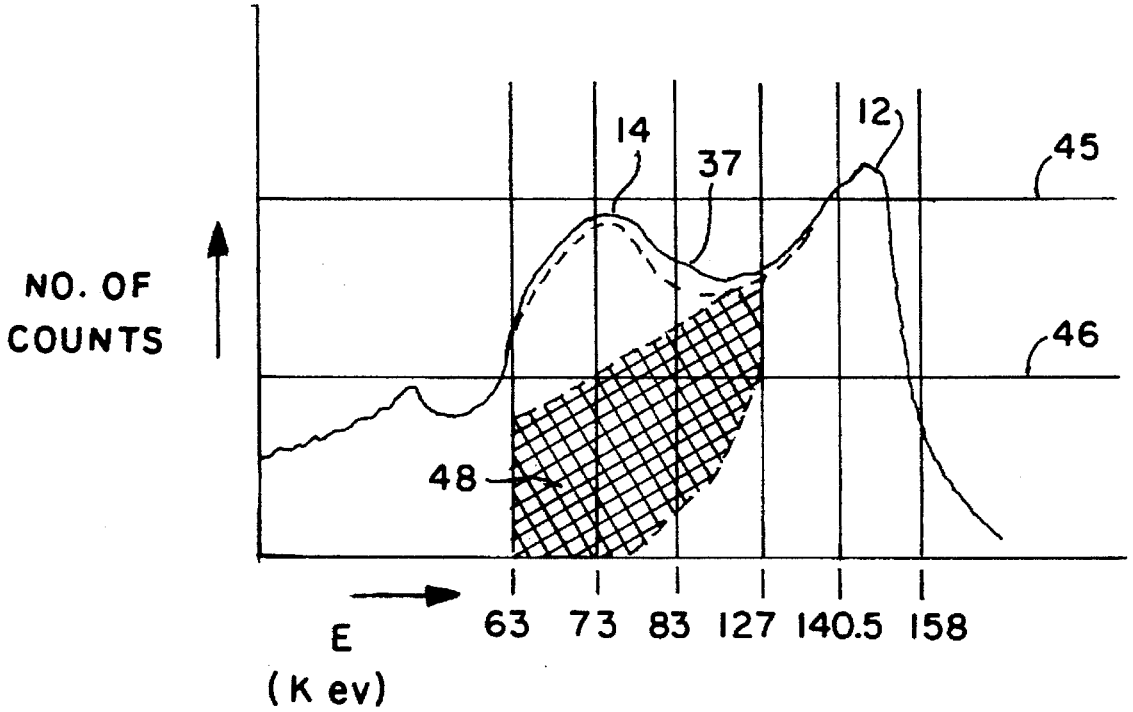
FIG. 3 is an energy spectrograph similar to FIG. 2 but without using the present invention.

Despite the improvements in resolution in the Anger camera, when simultaneously imaging thallium and technetium, pulse heights such as that shown in FIG. 3 have been observed. Specifically, the thallium pulse has been distorted to such an extent that reasonably accurate imaging has not been achieved.

As is known in the art, collimator 15 does not, in a sense, function to collimate or shape the X-ray or gamma ray beam but acts more in the sense of an aperture permitting the transmission of rays over a discrete area to scintillation crystal 17. The thickness "T" of septa 50 is established to ensure that rays entering tubular collimator passageway 54 at an angle to passageway centerline 57 strike septa 50 where they are absorbed. This permits, in theory, only the X-rays travelling substantially parallel to centerline 57 of tubular collimator passageway 54 to strike scintillation crystal 17 head on thus producing accurate pulse counts. However, it has been found that scattered and secondary radiation resulting from gamma rays passing into tubular collimator passageway 54 at an angle to centerline of passageway 57, (defined as cross channel radiation when it strikes any part of tubular collimator passageway 54) while not numerically significant, nevertheless adversely affects the photopeak window such that pulses of the type shown in FIG. 3 result. The cross channel radiation attributed to technetium ray 12 is diagrammatically shown in FIG. 3 by the cross-hatched area indicated by reference numeral 48. The objective of the invention is to reduce cross-hatched area 48 to an area which will not interfere with the camera's ability to detect or image thallium photopeak 14.

As is well known, gamma rays interact with matter in one of three ways, namely, photo emission, Compton effect, or electron-positron pair production. The photo emission or photo electric interaction is most likely to occur when the energy of the incident photon is slightly greater than the binding energy of the electrons in one of the inner shells of the septa, usually the K-shell which has the highest binding energy. When the incident photon gives up all of its energy to the atom, the atom, in response, ejects an electron usually from the K-shell and is placed in an excited state. The hole in the K-shell is immediately filled by transition of an electron from one of the outer shells, i.e., usually the L-shell, and during the transition of the L-electron to the hole in the K-shell, the energy difference between these shells is radiated as a photon known as a fluorescent or characteristic X-ray which has the characteristic of the septa. The characteristic X-ray emitted by lead is 77.5 KeV which happens, unfortunately, to fall within the spectrum or pulse height of thallium ray 14. Thus, technetium ray 12 will emit secondary radiation resulting from cross channel interaction with lead septa which will sporadically occur and adversely influence the photopeak. Because of sporadic occurrence, it is not possible to use PSD techniques such as contained in discriminator circuit 28 to account for the secondary radiation nor is it possible to use other techniques such as binning, which statistically factors each channel to account for the emitted radiation.

In addition to the secondary radiation, there is also scattered radiation which adversely affects the photopeak. Incident low energy photons may simply be coherently scattered so that the energy of the electromagnetic wave stays the same as that of the incident photon but simply changes its direction. More likely, the incident photon will dislodge a loosely bound outer shell electron and change its direction. The dislodged electron known as the Compton or recoil electron, requires a certain amount of energy which must be subtracted from the scattered photon. The scattered photon proceeds down tubular collimator passageway 54 at a lesser energy which likewise can and does distort the photopeak window. While the Compton or recoil electron effect can and is factored or accounted for by PSD techniques, the scattered photon or the scattered radiation (and the secondary radiation as discussed above), cannot be mathematically factored and distorts the photopeak window. It should also be noted that electron-positron pair production does not enter into the discussion since the energy of each photon of the pair, 0.51 MeV, is not within the energy spectra under discussion.

The invention addresses this problem by adding a thin filter plate 60 to the entrance end 55 of tubular collimator passageway 54 and also to the exit end 56 of tubular collimator passageway 54 to remove a high percentage of the cross channel scattered and secondary radiation. In the alternative embodiments, filter plate 60 is added only to exit end 56 of tubular collimator passageway 54 or only to entrance end 55 of tubular collimator passageway 54. However, it is preferred to add filter plate 60 at both ends 55, 56.

More particularly, filter plate 60 is a relatively thin plate (almost a masking) which has a thickness of only about 1 or 2 mm. Filter plate 60 has a plurality of openings extending therethrough which are shaped to correspond exactly to the opening "D" in tubular collimator passageway 54 and which are precisely aligned to overlie or to be coincident and contiguous with an end 56 and/or 55 of tubular collimator passageway 54. Filter openings 61 thus define a filtering edge wall 62 which, as noted, is no more than about 1 to 2 mm long.

The invention does not eliminate all cross channel radiation. Technetium rays at a slight angular inclination to longitudinal centerline 57 such as designated by reference numeral 65 in FIG. 5 may strike septa 50, liberate a K-shell electron producing a fluorescent K-shell photon which travels through tubular collimator passageway 54 unimpeded and strikes scintillation crystal 17. The invention does not correct for any such cross channel radiation. However, a significant amount of incoming radiation at an angle designated as "B" relative to centerline 57 does produce fluorescent K-shell photons which will strike filter plate 60 adjacent exit end 56 of tubular collimator passageway 54. This is shown, for example, by ray 66 in FIG. 5. Once this K-shell radiation (i.e., rays 66) strikes filter plate 60 adjacent exit end 56 of columnar passage 56 the characteristic and scattered rays resulting therefrom is dropped in energy level to values as low as 8 to 10 KeV which do not affect the photopeak window (having been removed by minimum band line 46). In the preferred embodiment, filter plate 60 is also added adjacent inlet end 55 of tubular collimator passageway 54 which filter plate 60 is struck by incoming radiation passing through an additional angle relative to centerline 57 shown as "A" in FIG. 5. Thus, in the preferred embodiment, radiation passing through angles A and B is filtered by filter plates 60. Furthermore, radiation passing into tubular collimator passageway 54 at angles (other than angles A & B) causing multiple collisions with septa 50 within tubular collimator passageway 54 will either be absorbed by septa 50 or produce scattered or secondary radiation reduced in energy to a level which does not distort photopeak window, or contact filter plate 60 at exit 55 or, some insignificant amount may strike crystal 17. Surprisingly, filter plate 60 reduces the interfering cross channel radiation sufficiently to avoid the photopeak distortion depicted in FIG. 3.

Those skilled in the art will recognize that absorption by filter plate 60 of cross channel radiation is a function of the atomic number Z of filter plate 60 and the thickness of filtering edge wall 62. As to the atomic number, in the preferred embodiment, filter plate 60 is a graded plate composed of several layers (not shown) which are matched to the fluorescent radiation of the incoming radiation in a manner not dissimilar to the concept used in a Thoreaus compound filter. Thus, filter 60 adjacent inlet 55 of tubular collimator passageway 54 could have one graded composition while filter 60 adjacent outlet 56 of tubular collimator passageway 54 could have another graded composition or be a single element.

As to the length of filtering edge 62, those skilled in the art will understand that a length of about 1 to 2 mm is sufficient. For example, half value layers for various materials such as that set forth in an April, 1968 publication of the U.S. Department of Health, Education and Welfare, titled "*Half Value Layers at Photon Energies from* 10 *KeV to* 10 *Mev*", by Gerald L. Rhinehart and Norman F. Modine, show, for example, that copper of about 1 mm thickness will reduce 77.5 KeV radiation to one half its energy so that 75% of such radiation would be reduced when passing through copper having thickness of about 2 mm. Half value lifes (HVL) for other materials not shown in the publication can be determined according to the accepted formula:

$$HVL=0.6931/[D.\mu_m(E)]$$

where:

D=the density of the material;

$\mu_m(E)$=the total mass absorption coefficient of material for photons of quantum energy E; and 0.6931 stands for ln 2

In accordance with the invention, the thickness of filter plate 60 or length of filtering edge 62 is chosen and sized with a selected material composition thereof (graded or ungraded) to effectively absorb above 80–90% of the cross channel radiation striking filtering edge 62. At the same time, the length of filtering edge 62 is minimized so as not to distort collimator geometry.

As noted in the preferred embodiment, collimator body or septa 50 is preferably lead and filter plate 60 is preferably tin, copper or cadmium, or combination thereof, having a lower atomic number Z. Reference to "atomic number" as used herein in describing collimator body 50 and filter plate 60 is intended to include elemental materials, alloys, composites, etc. wherein all of the component elements have the required atomic numbers as described above or are present in amounts resulting in negligible contribution of secondary radiation on exposure to primary radiation in the above described system. In accordance with the broader aspects of the invention, the material of septa 50 and the material of filter plate 60 is selected so that the fluorescent radiation emitted from the septa can be reduced or filtered by the filtering material to an energy level which does not distort the photopeak window.

It must be appreciated that filter plate 60 cannot extend over the opening of tubular collimator passageway 54 since the filtering action would adversely affect the energy levels of the parallel rays traveling through tubular passageway 57. In fact, no portion of filter plate 60 can extend over any portion of the opening of tubular collimator passageway 54. Further, while it is possible to place filtering material onto the wall of tubular collimator passageway 54 at various positions between tubular passageway ends 55, 56, this will affect the absorption and attenuation characteristics of the radiation and thus the geometry of collimator 15. Thus it is preferred that filter plate 60 only be positioned at the ends of tubular collimator passageway 54. Further, the thickness of filter plate 60 should be kept at a minimum so as not to distort the collimator absorption geometry. That is, it is not desired for gamma rays 14, 16 in their initial energy state to interact with filter plate 60 prior to entering scintillation crystal 17 since filtering plate 60 will always have an atomic number less than septa 50 and produce characteristic and scattered radiation that will otherwise distort the photopeak window.

Figure 7:
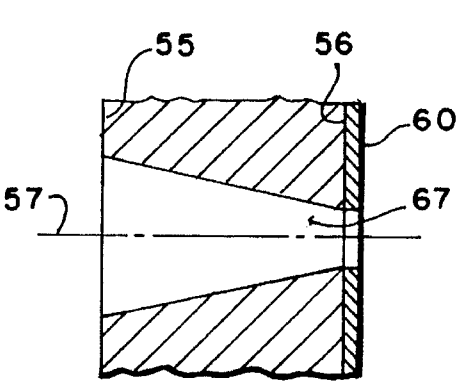
FIG. 7 is a cross-sectional view similar to FIG. 5 of an alternative embodiment of the invention with a collimator passageway which is shown as converging.
Figure 6:
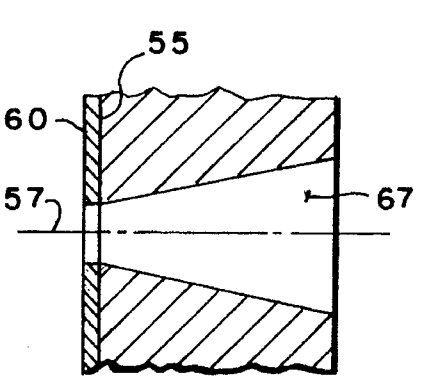
FIG. 6 is a cross-sectional view similar to FIG. 5 of an alternative embodiment of the invention with a collimator passageway shown as diverging.

Tubular collimator passageway 54 can be any conventional shape such as hex, round, square, triangle or rectangular. The shape can be a diverging passageway 66 as shown in FIG. 6 for magnification or there can be provided a converging passageway 67 such as shown in FIG. 7 to provide demagnification, thereby allowing imaging of objects larger than the field of view of a collimator with parallel passageways. Also, for purposes of illustration, filter plate 60 is applied to entrance end 55 of tubular passageway 66 shown in FIG. 6 while filter plate 60 is applied to exit end 55 of converging tubular passageway 67 shown in FIG. 7. Again, it is preferred that filter plate be applied to both ends 55, 56 to produce the highest elimination of cross channel radiation. Applying filter plate 60 to entrance end 55 results in the least elimination of radiation. Applying filter plate only to exit end 56 will, it is believed, produce satisfactory imaging.

Figure 8:
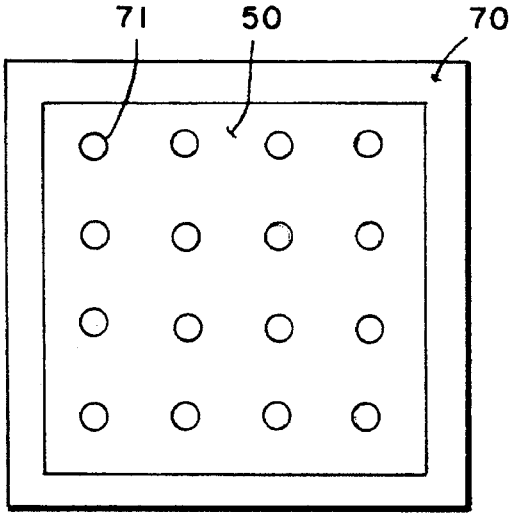
FIG. 8 is a schematic top plan view of a mold for casting a collimator with passageway core pins inserted therein.
Figure 9:
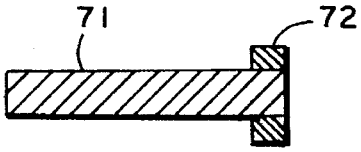
FIG. 9 is a longitudinal, cross-sectioned view of a core pin used in the mold of FIG. 8.

In the preferred embodiment, filter plate 60 is simply a thin leaf or plate with openings 61 punched therein and is bonded by a suitable epoxy to one or both ends 55, 56 of collimator body 50. Jigs and fixtures are used to insure precise positioning of filter plate openings 61 with tubular collimator passageways 54. Alternatively, collimators are typically formed by casting septa 50 in a mold 70 diagrammatically shown in FIG. 8 into which are positioned aluminum core pins 71 which have an outside configuration forming tubular collimator passageways 54. Aluminum core pin 71 is chemically etched or dissolved from septa 50 after collimator 15 is cast. In accordance with the invention, one or both ends of each aluminum core pin 71 is coated with a filtering material 72 as shown in FIG. 9. Filter 72 is impervious to the chemical etch subsequently used to dissolve core pin 71. Filter 72 can be a composite, and in effect, can comprise several maskings of different materials bonded to one another, such as by heat fusion or the like.

Figure 10:
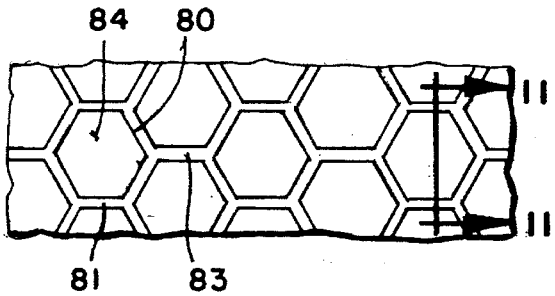
FIG. 10 is a schematic end view of a portion of a collimator formed from metallic foil.
Figure 11:
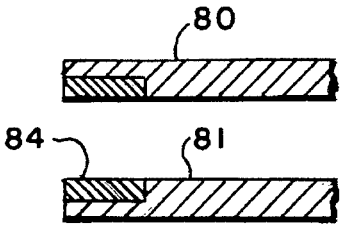
FIG. 11 is a sectioned view of a portion of the metallic foil collimator shown in FIG. 10 taken along lines 11—11 of FIG. 10.

It is also known to form collimator 15 by use of metal foil (lead foil) bent or shaped into the configuration of tubular collimator passageways 54. See for example the structure disclosed in Platz U.S. Pat. No. 3,943,366. Such collimator would have a corrugated top strip 80 forming one-half of tubular collimator passageway 54 which would match a corrugated, identically shaped bottom strip 81. Top and bottom strips 80, 81 are then bonded at adjacent tubular collimator passageways 54 such as shown by reference numeral 83 in FIG. 10. In accordance with the invention a filter insert 84 as best shown in FIG. 11 is inserted into one or both ends of top and bottom corrugated strips 80, 81. Alternatively, top and bottom corrugated strips 80, 81 are simply bimetallic with the filter material formed at the ends.

Finally, while it is clear that the filter must be at the end(s) of tubular collimator passageway 54 and aligned with tubular collimator passageway 54 so as not to obstruct or block it, the length or portions of the length of tubular collimator passageways 54 could also be coated or masked with a filtering material. As noted, such construction is not especially preferred because of the expected adverse effect on collimator geometry. However, the invention would still function in such a configuration.

The invention has been described with reference to preferred and alternative embodiments. The objective is to reduce, and for all intents and purposes, eliminate for imaging purposes, cross channel scattered and secondary radiation from the collimator passageways before the radiation strikes the scintillation crystal. Other applications and alterations may suggest themselves to those skilled in the art upon reading and understanding the detailed description of the invention. For example, there are other ways to apply the filter to stamp, cast or foil collimators other than those suggested herein. Also, while the invention has been described with reference to a collimator having a fixed thickness, it can also be applied to those collimators described above which have means to vary the length and shape of the tubular collimator passageways. It is intended to include all such modifications and alterations in-so-far as they come within the scope of the present invention.

Having thus described the invention it is claimed:

1. An X-ray collimator for use in a medical nuclear camera comprising:

a body of radioactive absorbing material having an entrance end adjacent a source of radiation and an exit end adjacent a radiation sensing medium, said body having a first plurality of tubular passageways extending therethrough; and an X-ray filter material having an edge thickness of about 1 to 2 mm affixed to at least one of said body ends, said filter material having a second plurality of openings extending through said edge thickness equal in number to said passageways, each opening aligned with a corresponding passageway to be co-incident and contiguous with said passageway at said end thereof, said filter material being composed of layers of different materials bonded to one another.

2. The collimator of claim 1 wherein each tubular passageway increases in cross-sectional area from said entrance end to said exit end.

3. The collimator of claim 1 wherein each tubular passageway decreases in cross-sectional area from said entrance end to said exit end.

4. The collimator of claim 1 wherein said body material has a higher atomic number than said filter material.

5. The collimator of claim 1 wherein said body material is lead and said filter material is selected from the group consisting of copper, tin and cadmium.

6. The collimator of claim 1 wherein said filter material is positioned adjacent said exit end of said body.

7. The collimator of claim 1 wherein said filter material is positioned adjacent said entrance end.

8. The collimator of claim 1 wherein said filter material is positioned adjacent said entrance end and said exit end.

9. The collimator of claim 1 wherein said body is a casting.

10. The collimator of claim 1 wherein said body is a stamping.

11. The collimator of claim 1 wherein said body is formed of a metallic foil folded to form said tubular passageway.

12. The collimator of claim 1 wherein said different materials is selected from the group of cadmium, tin and copper.

13. A nuclear camera for simultaneously recording technetium and thallium radioactive isotopes having half-life decay characteristics which emit distinctive gamma rays while retaining the ability to record gamma rays emitted from a single radioactive isotope, said camera comprising:

radiation sensing means for sensing said gamma rays;

signal processor means for producing voltage pulses proportional to the energy of said gamma rays detected by said radiation sensing means;

a lead collimator interposed between said radiation sensing means and said source isotopes, said collimator having a radiation absorbing body producing fluorescent X-rays from technetium rays falling within the X-ray spectrum produced by said thallium rays, said radiation absorbing body extending between an entrance end and an exit end and having a plurality of tubular passageways extending therethrough from said entrance to said exit end; and an X-ray filter plate affixed to one of said collimator ends and composed of material selected from the group consisting of copper, tin and cadmium, said filter plate having a plurality of openings equal in number to said tubular passageways, each opening defined by a filtering edge shaped to be co-incident with said tubular passageway at said end thereof and aligned with a corresponding passageway so that the filtering edge extends said passageway a distance equal to the thickness of said filter plate, said fluorescent X-rays produced by said technetium rays being substantially absorbed by said filter edge.

14. The camera of claim 13 wherein said filter plate is positioned adjacent said exit end of said body.

15. The camera of claim 13 wherein a second filter plate is positioned adjacent the other of said collimator ends.

16. The camera of claim 13 wherein said filtering edge has a distance of 1 to 2 mm.

* * * * *